US009415589B2

(12) United States Patent
Morizono et al.

(10) Patent No.: US 9,415,589 B2
(45) Date of Patent: Aug. 16, 2016

(54) PRINTING APPARATUS AND METHOD FOR COLOR-CORRECTING PRINTING ON RECORDING MEDIUM

(71) Applicants: SCREEN Holdings Co., Ltd., Kyoto (JP); Ricoh Company, Ltd., Tokyo (JP)

(72) Inventors: Osamu Morizono, Kyoto (JP); Takaharu Yamamoto, Kyoto (JP); Kunio Muraji, Kyoto (JP); Shoji Kakimoto, Kyoto (JP)

(73) Assignees: SCREEN Holdings Co., Ltd. (JP); Ricoh Company, Ltd. (JP)

( * ) Notice: Subject to any disclaimer, the term of this patent is extended or adjusted under 35 U.S.C. 154(b) by 0 days.

(21) Appl. No.: 14/807,093

(22) Filed: Jul. 23, 2015

(65) Prior Publication Data

US 2016/0031209 A1 Feb. 4, 2016

(30) Foreign Application Priority Data

Jul. 30, 2014 (JP) ..... 2014-155224
Sep. 9, 2014 (JP) ..... 2014-183481

(51) Int. Cl.
*B41J 11/00* (2006.01)
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 11/007; B41J 11/008
USPC ..... 347/5, 9, 12, 14, 16, 17, 19, 101
See application file for complete search history.

(56) References Cited

U.S. PATENT DOCUMENTS 6,246,857 B1 * 6/2001 Tanaka ..... H04N 1/506 399/301
7,434,904 B2 * 10/2008 Tanaka ..... B41J 3/28 347/14
2005/0053388 A1 * 3/2005 Yokoyama ..... G03G 15/1625 399/66
2006/0024104 A1 * 2/2006 Castelli ..... G03G 15/0163 399/372
2009/0231614 A1 * 9/2009 Oku ..... H04N 1/047 358/1.15
2012/0139180 A1 * 6/2012 Ohshima ..... B65H 7/02 271/258.01
2012/0141148 A1 * 6/2012 Ohshima ..... G03G 15/6529 399/18
2013/0195482 A1 * 8/2013 Nakura ..... B65H 5/06 399/45

FOREIGN PATENT DOCUMENTS

JP 2014-024266 2/2014

* cited by examiner

*Primary Examiner* — Stephen Meier
*Assistant Examiner* — Alexander D Shenderov
(74) *Attorney, Agent, or Firm* — Ostrolenk Faber LLP

(57) ABSTRACT

Disclosed is an inkjet printing apparatus with an inkjet printing unit performing printing onto web paper to be transported. The apparatus includes a drive roller transporting the web paper, a transportation velocity detector detecting a transportation velocity of the web paper, an encoder generating a timing reference signal of the printing by the printing unit in accordance with transportation of the web paper, the encoder being disposed in a transport roller, a printing correction data generator generating printing correction data in accordance with the transportation velocity and the timing reference signal so as to correspond to a time-dependent variation of the transport roller provided with the encoder; and an offset corrector correcting the printing of the inkjet printing unit to the web paper in accordance with the printing correction data.

11 Claims, 12 Drawing Sheets

PRINTING APPARATUS AND METHOD FOR COLOR-CORRECTING PRINTING ON RECORDING MEDIUM

TECHNICAL FIELD

The present invention relates to a printing apparatus and a printing method of correcting a color shift generated upon printing in a transportation direction of a recording medium.

BACKGROUND ART

A currently-used inkjet printing apparatus is known having one printing unit with a plurality of printing heads arranged in a transportation direction of a recording medium (e.g., web paper). See, for example, Japanese unexamined Patent Publication No. 2014-24266A. Such a printing apparatus described in the above Patent Literature has the printing heads for colors black (Bk), cyan (C), magenta (M), and yellow (Y) that are arranged in order in the transportation direction.

With the printing unit having the above configuration, the printing heads adjacent in the transportation direction have different printing timings, thereby allowing printing with corresponding colors at positions in response to image data. A printing timings is determined in accordance with a transportation velocity of the recording medium and a distance between the adjacent printing heads.

However, the example of the conventional apparatus with such a configuration has the following drawback. That is, in the inkjet printing apparatus, the printing timing is controlled in accordance with a signal detected by an encoder. The encoder is provided in a roller contacting the recording medium. Examples of the recording medium include one subjected to coating printing, or having one face printed and dried prior to the printing by the printing heads. Here, the recording medium is heated due to drying. Transportation of the heated recording medium causes the roller to be heated and thus to be expanded thermally. This leads to a delay of the detection signal from the encoder. Consequently, discharge timings of ink droplets from each of the printing heads are shifted. As a result, a color shift occurs in the printed recording medium.

Description will be made with reference to FIGS. 1A to 1C and FIGS. 2A to 2C. FIGS. 1A to 1C each illustrate a flow chart of printing when a roller with an encoder is not expanded thermally. FIGS. 2A to 2C illustrates a flow chart of printing when the roller is expanded thermally.

In FIGS. 1A to 1C, a roller 81 has a perimeter L, and paper 82 is transported at a velocity V. The perimeter L of the roller 81 and the transportation velocity V have a relationship of V=L/t. Here, it is assumed that inkjet heads 83 for various colors are each arranged by a distance L, and a first inkjet head 83 is disposed downstream by a distance L from the roller 81. That is, a distance between the roller 81 and the inkjet head 83 for black (Bk) is denoted by L, and a distance between the roller 81 and an inkjet head 83 for yellow (Y) is denoted by 4L. The encoder outputs a timing reference signal in synchronization with rotation of the roller 81, whereby ink droplets are discharged from each of the inkjet heads 83 in accordance with the signal.

The following describes printing of ink droplets in different colors onto the paper 82 on the same line in the transportation direction. As illustrated in FIG. 1B, after the paper 82 passes the roller 81, the inkjet head 83 for black receives a discharge signal at time t, thereby printing a dot 84 in black. Moreover, a discharge signal is inputted at time 4*t*, whereby a dot 85 in yellow is printed. This allows printing of the dot 84 in black and the dot 85 in yellow onto the paper 82 on the same line in the transportation direction, as illustrated in FIG. 1C.

On the other hand, it is assumed as illustrated in FIG. 2A that the roller 81 provided with the encoder is expanded thermally to cause its perimeter to increase to be of L+a. However, the transportation velocity V of the paper 82 is controlled constant to be V=L/t. Consequently, an angular velocity of the roller 81 becomes low, and a time interval of the timing reference signals from the encoder becomes longer. As a result, a shift in discharge timing occurs among the inkjet heads.

Accordingly, as illustrated in FIG. 2B, after the paper 82 passes the roller 81, the inkjet head 83 for black receives a discharge signal at a timing t+t'. Correspondingly, the dot 84 is shifted backward in the transportation direction by a distance where the paper 82 travels during time t'. Moreover, the inkjet head 83 for yellow receives a discharge signal at a timing 4($t+t'$). Correspondingly, the dot 85 is shifted backward in the transportation direction by a distance where the paper 82 travels during time 4*t*'. As a result, as illustrated in FIG. 2C, a positional shift occurs between the dot 84 in black and the dot 85 in yellow although the both dots should be printed on the same line. Here, the time t' has a relationship of t'=a/L·t. Thus, the dots 84 and 85 are printed while being shifted backward by distances a and 4*a*, respectively, each from a position to be printed on the image data. Accordingly, a shift 3*a* occurs between the inkjet head 83 for black closest to the encoder and the inkjet head 83 for yellow furthest from the encoder. This causes an increased color shift.

SUMMARY OF INVENTION

The present invention has been made regarding the state of the art noted above, and its one object is to provide a printing apparatus and printing method that allow reduction in color shift upon printing even onto a heated recording medium.

In order to accomplish the above object, the present invention adopts the following construction. One embodiment of the present invention discloses a printing apparatus with a printing unit performing printing onto a recording medium to be transported. The apparatus includes a transporting unit transporting the recording medium; a transportation velocity detector detecting a transportation velocity of the recording medium; a timing reference signal generator generating a timing reference signal of the printing by the printing unit in accordance with transportation of the recording medium; a printing correction data generator generating printing correction data in accordance with the transportation velocity and the timing reference signal so as to correspond to a time-dependent variation of the timing reference signal generator; and a printing corrector correcting the printing of the printing unit to the recording medium in accordance with the printing correction data.

With the printing apparatus according to the present embodiment, the timing reference signal generator as a reference of printing timing is heated by contact to the recording medium, thereby being subjected to a time-dependent variation. In contrast to this, the correction data corresponding to the time-dependent variation of the timing reference signal generator is generated from the timing reference signal and the transportation velocity of the recording medium detected by the transportation velocity detector provided separately from the timing reference signal generator. Then the printing correction is performed in accordance with the correction data. This allows suppression in printing timing shift in association with the time-dependent variation of the timing reference signal generator, causing reduction in color shift upon the printing. As a result, this allows reduction in color shift upon the printing even onto the heated recording medium.

In the present embodiment mentioned above, it is preferable that the timing reference signal generator includes a roller contacting to the recording medium, and an encoder connected to the roller, and the timing reference signal is a detection signal of the encoder. The encoder is connected to the roller contacting to the recording medium. The detection signal of the encoder is used as the timing reference signal. This allows appropriate control of the printing timing. In addition, the use of the detection signal of the encoder also allows detection of thermal expansion of the roller with higher accuracy than detection using a temperature sensor.

In the present embodiment mentioned above, it is preferable that the printing correction data generator generates printing correction data in accordance with a variation in perimeter of the roller to which the encoder is connected. The printing correction data is generated in accordance with the variation in perimeter of the roller connected to the encoder. This allows detection of a variation in thermal expansion of the roller with high accuracy, and also allows high-accurate reduction in color shift upon the printing.

In the present embodiment mentioned above, it is preferable that the printing correction data generator stores a variation in perimeter of the roller upon termination of the printing, and estimates printing correction data upon start of a posterior printing stage of the printing across downtime in accordance with the downtime and the perimeter of the roller upon termination of an anterior printing stage of the printing, the printing including the posterior printing stage and the anterior printing stage. This allows estimation of the printing correction data upon the start of the posterior printing after the downtime with high accuracy. As a result, the color shift at an early stage of the printing can be reduced efficiently.

In the present embodiment mentioned above, it is preferable that the printing correction data generator switches the printing correction data, to be outputted to the printing corrector, from the estimated printing correction data to the printing correction data, generated in accordance with the transportation velocity and the timing reference signal, depending on at least either a transportation distance of the recording medium from start of the printing or elapsed time from the start of the printing. This allows switch of the printing correction data to be outputted to the printing corrector at a timing that the printing correction data can be generated appropriately in accordance with the transportation velocity and the timing reference signal. As a result, satisfactorily reduced color shift is obtainable both before and after the switch.

In the present embodiment mentioned above, it is preferable that the transporting unit includes a transport roller transporting the recording medium and a motor driving the transport roller, and the transportation velocity detector detects the transportation velocity in accordance with a drive command signal to the motor. The transportation velocity is detected in accordance with the drive command signal of the motor for driving the transport roller. Consequently, the transportation velocity of the recording medium is determinable simply and high-accurately without a velocity sensor.

In the present embodiment mentioned above, it is preferable that the printing correction data generator generates printing correction data also in accordance with the variation in perimeter of the transport roller. The printing correction data is generated also in accordance with the variation in perimeter of the transport roller. Consequently, the transportation velocity is detectable preciously even with the variation in perimeter of the transport roller due to its thermal expansion. This achieves reduction in color shift upon the printing caused by the thermal expansion of the transport roller.

In the present embodiment mentioned above, it is preferable that the printing correction data generator stores the printing correction data upon termination of the printing, and estimates printing correction data upon start of a posterior printing stage of the printing across downtime in accordance with the downtime and the printing correction data upon termination of an anterior printing stage of the printing, the printing including the posterior printing stage and the anterior printing stage. This allows accurate estimation of the printing correction data upon the start of the printing after the downtime. As a result, a satisfied reduction in color shift at an initial printing is obtainable.

In the present embodiment mentioned above, it is preferable that the printing correction data generator switches the printing correction data, to be outputted to the printing corrector, from the estimated printing correction data to the printing correction data, generated based on the transportation velocity and the timing reference signal, depending on at least either a transportation distance of the recording medium from start of the printing or elapsed time from the start of the printing. This allows switch of the printing correction data to be outputted to the printing corrector in accordance with the transportation velocity and the timing reference signal at a timing when the printing correction data can be generated appropriately. As a result, efficient reduction in color shift is obtainable both before and after the switch.

In the present embodiment mentioned above, it is preferable that the printing corrector corrects an offset of an image data in the transportation direction in accordance with the printing correction data. The offset of the image data is corrected in accordance with the printing correction data. This allows reduction in color shift upon the printing.

In the present embodiment mentioned above, it is preferable that the printing unit includes inkjet heads each discharging ink droplets, and the printing corrector corrects a discharge timing of the ink droplets to the recording medium in accordance with the printing correction data. The discharge timing of the ink droplets is corrected in accordance with the printing correction data. This allows reduction in color shift upon the printing.

Another embodiment of the present invention discloses a printing method of performing printing onto a recording medium to be transported. The method includes a transportation velocity detecting step of detecting a transportation velocity of the recording medium; a timing reference signal generating step of generating a timing reference signal of the printing generated by a timing reference signal generator in accordance with the recording medium; a printing correction data generating step of generating printing correction data in accordance with the transportation velocity and the timing reference signal so as to correspond to a time-dependent variation of the timing reference signal generator; and a printing correcting step of correcting the printing of the printing unit to the recording medium in accordance with the printing correction data.

With the printing method according to the embodiment of the present invention, the correction data corresponding to the time-dependent variation of the timing reference signal generator is generated in accordance with the transportation velocity of the recording medium detected in the transportation velocity detecting step and the timing reference signal generated in the timing reference signal generating step. Moreover, the printing correction is performed in accordance with the correction data. This allows suppression in printing timing shift in association with the time-dependent variation of the timing reference signal generator, causing reduction in color shift upon the printing. As a result, this allows reduction in color shift upon the printing even onto the heated recording medium.

In the present embodiment mentioned above, it is preferable that the printing unit includes inkjet heads each discharging ink droplets, and the printing correcting step includes correcting a discharge timing of the ink droplets to the recording medium in accordance with the printing correction data. The discharge timing of the ink droplets is corrected in accordance with the printing correction data. This allows reduction in color shift upon the printing.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

The following describes preferred embodiments of the present invention with reference to drawings.

Embodiment 1

Figure 3:
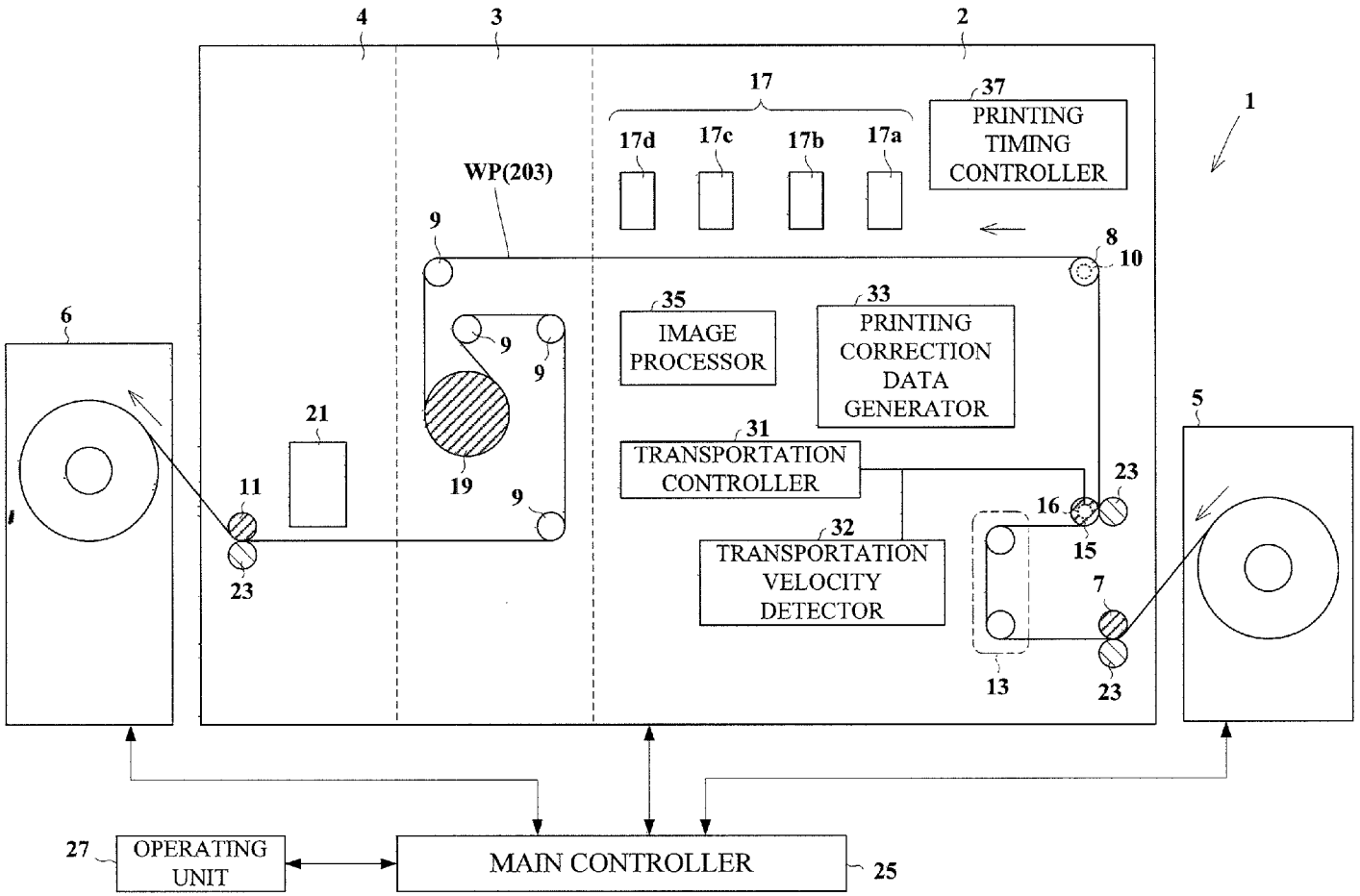
FIG. 3 schematically illustrates an inkjet printing apparatus according to Embodiment 1 of the present invention.

The following describes Embodiment 1 of the present invention with reference to drawings. FIG. 3 schematically illustrates an inkjet printing apparatus according to the present embodiment.

An inkjet printing apparatus 1 includes a print unit 2 performing printing onto sheet web paper WP, a drying unit 3 drying the printed web paper WP, an inspecting unit 4 inspecting the printed web paper WP, a paper feeder 5 feeding the web paper WP to the print unit 2, and a take-up roller 6 taking up the printed web paper WP in a roll form.

The paper feeder 5 holds a roll of the web paper WP so as for the web paper WP to be rotatable about a horizontal axis, and unwinds the web paper WP from the roll of the web paper WP to feed the web paper WP to the print unit 2. The take-up roller 6 winds up the web paper WP inspected by the inspecting unit 4 about the horizontal axis. Regarding the side from which the web paper WP is fed as upstream and the side to which the web paper WP is taken up as downstream, the paper feeder 5 is disposed upstream of the print unit 2 while the take-up roller 6 is disposed downstream of the print unit 2.

The print unit 2 includes a drive roller 7 upstream thereof for taking in the web paper WP from the paper feeder 5. The web paper WP unwound from the paper feeder 5 by the drive roller 7 is transported downstream toward the take-up roller 6 along rotatable transport rollers 8 and 9 having no drive mechanism. A drive roller 11 is disposed between an inspecting device 21, to be mentioned later, and the take-up roller 6. The drive roller 11 feeds the web paper WP having passed the inspecting device 21, to be mentioned later, toward the take-up roller 6.

The print unit 2 includes the drive roller 7, an edge position controller 13, a drive roller 15, and an inkjet printing unit 17. The drying unit 3 includes a heat drum 19. The heat drum 19 contacts a rear face of the web paper WP to heat and dry ink droplets adhering on the web paper WP. The inspecting unit 4 includes the inspecting device 21, and the drive roller 11.

The web paper WP is transported to the drive roller 7, the edge position controller 13, the drive roller 15, the transport roller 8, the inkjet printing unit 17, the heat drum 19, the inspecting device 21, and the drive roller 11 in this order. A transportation path of the web paper WP is denoted by the numeral 203. When the web paper WP serpentines, the edge position controller 13 automatically adjusts the web paper WP to transport the web paper WP into a right position. The drive roller 15 rotates at a fixed velocity directed from a transportation controller 31. The drive roller 15 corresponds to a reference roller for a reference of the number of rotations of other drive rollers 7 and 11 and the heat drum 19.

Each of the drive rollers 7, 11, and 15 is provided with a rotatable nip roller 23. The nip roller 23 presses the drive rollers 7, 11, and 15 across the web paper WP, thereby applying a transportation force of the web paper WP. Pressure is applied by an air cylinder, for example. The rip roller 23 is composed of an elastic body such as rubber. The drive roller 15 is rotatably driven by a motor 16. The drive rollers 7 and 11 are each rotatably driven also by a motor not shown. The drive roller 15 and the motor 16 correspond to the transporting unit in the present invention.

The transport roller 8 between the drive roller 15 and the inkjet printing unit 17 includes an encoder 10. The encoder 10 is an incremental rotary encoder. The encoder 10 generates one Z-phase pulse signal for one rotation of the encoder 10. The signal is a timing reference signal of discharging ink droplets by the inkjet printing unit 17. Here, it is preferable to use the Z-phase pulse signal as the signal of the encoder in the present invention. This allows enhanced calculation accuracy for thermal expansion of the transport roller 8. The transport roller 8 and the encoder 10 correspond to the timing reference signal generator in the present invention.

The inkjet printing unit 17 includes inkjet heads 17*a*, 17*b*, 17*c*, and 17*d* discharging ink droplets in different colors. Specifically, the inkjet 17*a* discharges ink droplets in black (K), and the inkjet head 17*b* discharges ink droplets in cyan (C). The inkjet head 17*c* discharges ink droplets in magenta (M), and the inkjet head 17*d* discharges ink droplets in yellow (Y). The inkjet heads 17*a* to 17*d* for black (K), cyan (C), magenta (M) and yellow (Y) are disposed in this order from upstream along the transportation path 203. The inkjet heads 17*a* to 17*d* are each connected to an ink supply unit, not shown, for supplying ink droplets as necessary.

The heat drum 19 has an internal heater and is rotated. The heat drum 19 is rotated by a drive mechanism such as a motor or a gear not shown. The inspecting device 21 inspects the printed portions for any stains or omissions. The take-up roller 6 winds up the inspected web paper WP in a roll form.

The inkjet printing apparatus 1 includes a main controller 25 and an operating unit 27. The main controller 25 controls en bloc each element of the inkjet printing apparatus 1. The main controller 25 is formed by a central processing unit (CPU) and others. The operating unit 27 operates the inkjet printing apparatus 1. The operating unit 27 is formed by a touch panel, various switches, and others. The operating unit 27 also includes a personal computer. The operating unit 27 may input operations via a mouse, a keyboard, and the like.

The print unit 2 further includes the transportation controller 31, a transportation velocity detector 32, a printing correction data generator 33, an image processor 35, and a printing timing controller 37. The transportation controller 31, the transportation velocity detector 32, the printing correction data generator 33, the image processor 35, and the printing timing controller 37 are formed by an FPGA or a microprocessor, a memory, and the like.

The transportation controller 31 outputs a command signal pulse to the motor 16 rotating the drive roller 15 for transporting the web paper WP at a velocity directed from the main controller 25. The transportation velocity detector 32 receives a drive command signal pulse outputted from the transportation controller 31 to the motor 16, and detects a transportation velocity $V_M$ of the web paper WP in accordance with the signal. Here, it is preferable to calculate the transportation velocity from an average value of the drive command signal pulses since noise components are removable.

The printing correction data generator 33 generates printing correction data depending on the thermal expansion of the transport roller 8. The image processor 35 generates image data for every color in accordance with the printed image data. The printing timing controller 37 controls a discharge timing of ink droplets to be discharged from each of the inkjet heads 17*a* to 17*d* in accordance with the signal from the encoder 10.

Figure 4:
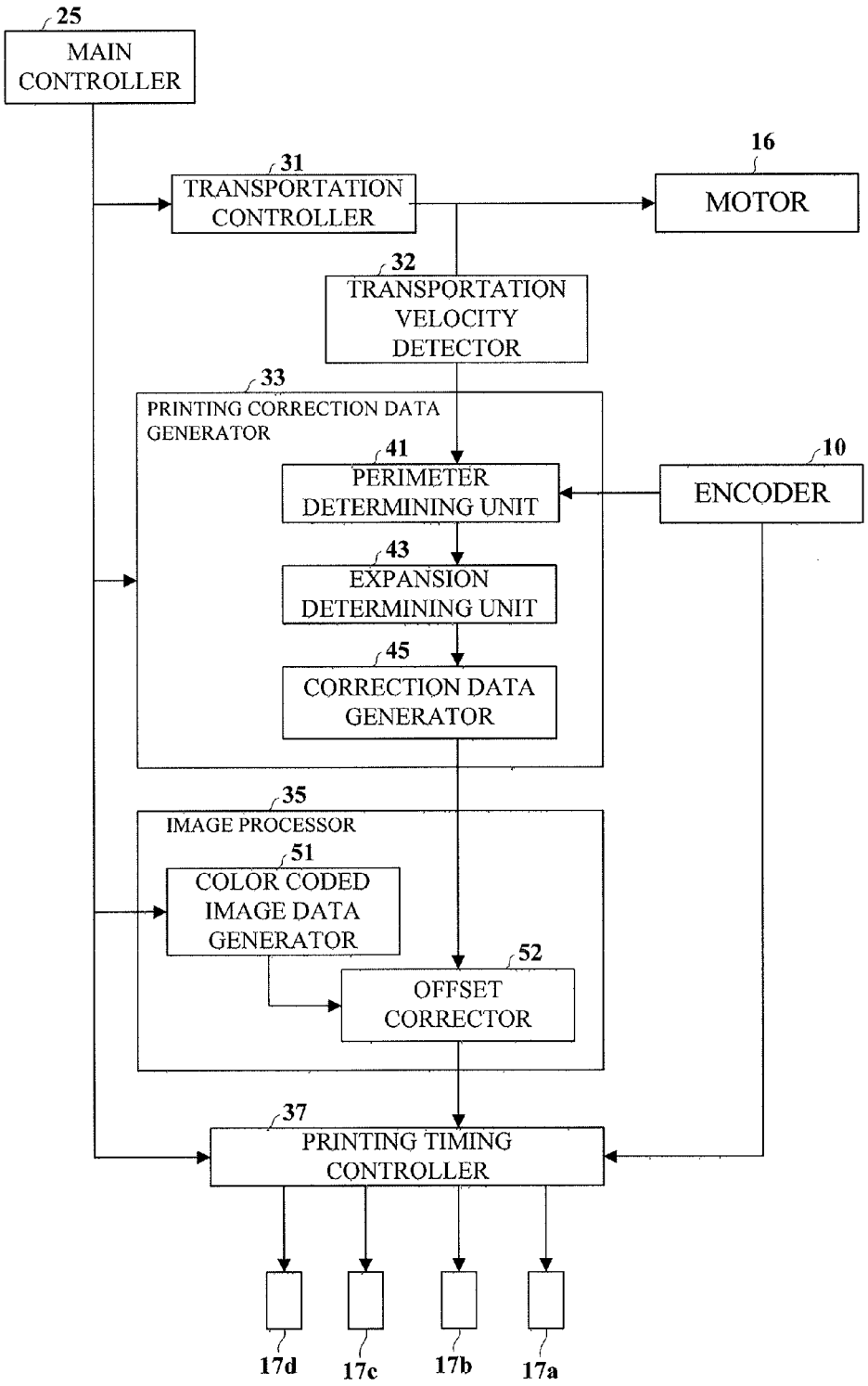
FIG. 4 is a function block diagram of a print unit according to the embodiment.

Reference is next made to FIG. 4. FIG. 4 is a function block diagram of a principal part of the print unit. The printing correction data generator 33 includes a perimeter determining unit 41, an expansion determining unit 43, and a correction data generator 45. The perimeter determining unit 41 determines a perimeter $L_E$ of the transport roller 8 provided with the encoder 10. The perimeter determining unit 41 receives a pulse signal of the encoder 10 and the transportation velocity $V_M$ detected by the transportation velocity detector 32.

The perimeter determining unit 41 determines the perimeter $L_E$ of the transport roller 8 from a pulse signal period $t_E$ of the encoder 10 in a Z-phase and the transportation velocity $V_M$ of the web paper WP. In Embodiment 1, the perimeter $L_E$ of the transport roller 8 is determined under the assumption that the drive roller 15 is not thermally deformed for ease calculation. Moreover, it is also assumed that the transportation velocity $V_M$ determined in accordance with the command signal to the motor 16 is equal to an actual peripheral velocity of the drive roller 15. The pulse signal period $t_E$ may be a period of one rotation of the encoder 10, or may be a time interval of a given pulse.

Assuming that the peripheral velocity $V_E$ of the transport roller 8 is equal to the peripheral velocity $V_M$ of the drive roller 15 (i.e., $V_E=V_M$), the following relation expression holds for the perimeter $L_E$ of the transport roller 8:

$$L_E=t_E\cdot V_E=t_E\cdot V_M \tag{1}$$

This reveals that the perimeter $L_E$ of the transport roller 8 is determinable from the pulse signal period $t_E$ of the encoder 10 in the Z-phase and the transportation velocity $V_M$ of the web paper WP. The pulse signal period $t_E$ can be calculated from the following relation expression with a count number Count and a one-clock time clk of the FPGA forming the printing correction data generating unit 33.

$$t_E=\text{Count}\cdot\text{clk} \tag{2}$$

The perimeter $L_E$ of the transport roller 8 determined in such a manner is outputted to the expansion determining unit 43.

The expansion determining unit 43 determines a difference between the received perimeter $L_E$ and a reference perimeter $L_o$ of the transport roller 8.

$$\Delta L=L_E-L_o \tag{3}$$

The determined difference ΔL is outputted to the correction data generator 45.

The correction data generator 45 calculates a shift amount S of an offset position of the printing image in the transportation direction in accordance with the thermally-expanded length ΔL of the perimeter.

$$S=\Delta L\cdot k/(\text{Inch/resolution}) \tag{4}$$

Figure 1A:
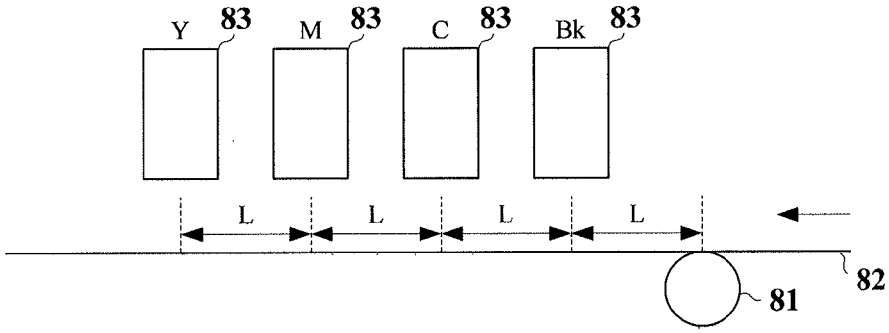
Fig.1A (PRIOR ART)
FIGS. 1A to 1C (PRIOR ART) each illustrate printing with a currently-used inkjet printing apparatus.
Figure 1B:
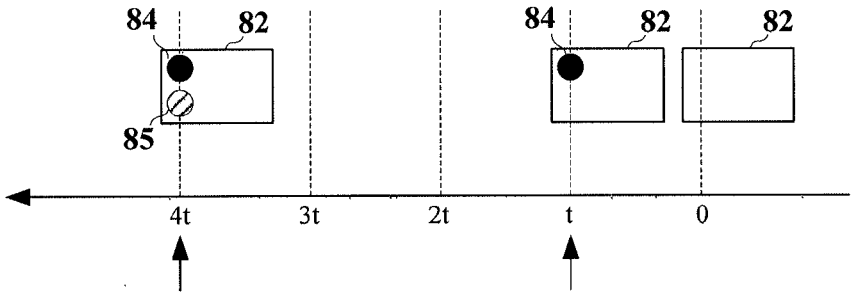
Fig.1B (PRIOR ART)
Figure 1C:
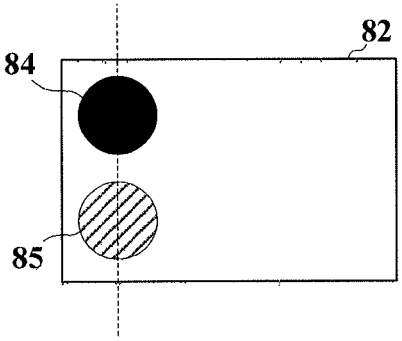
Fig.1C (PRIOR ART)
Figure 2A:
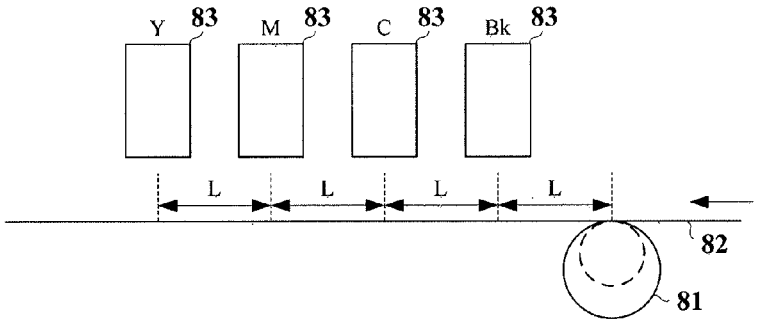
Fig.2A (PRIOR ART)
FIGS. 2A to 2C (PRIOR ART) each illustrate a color shift in a transportation direction with the currently-used inkjet printing apparatus.
Figure 2B:
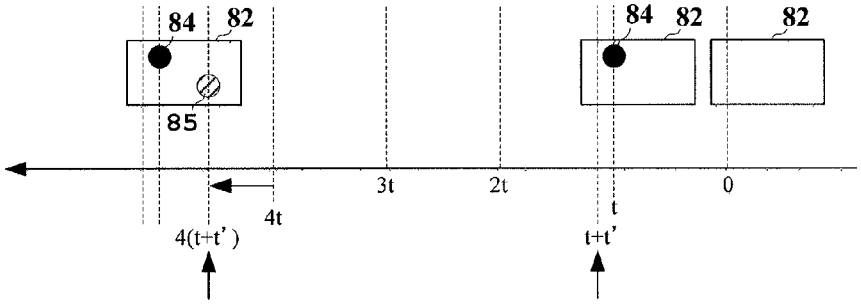
Fig.2B (PRIOR ART)
Figure 2C:
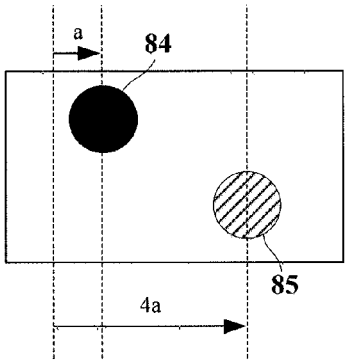
Fig.2C (PRIOR ART)

Here, the shift amount S is a data amount in a dot unit. The calculated shift amount S is outputted to the image processor 35. Here, the symbol k denotes a scale factor, and a numeric value about a color shift in each of the inkjet heads 17*a* to 17*d* is substituted into the symbol k. For instance, k equals 3 when a shift amount S for yellow is calculated with the inkjet head 83 for black as a reference in a positional relationship in FIG. 2A.

The image processor 35 includes a color coded image data generator 51, and an offset corrector 52. The color coded image data generator 51 generates image data for every color of the ink droplets in accordance with the image data received from the main controller 25. That is, four types of image data for black, cyan, magenta, and yellow are generated.

Figure 5:
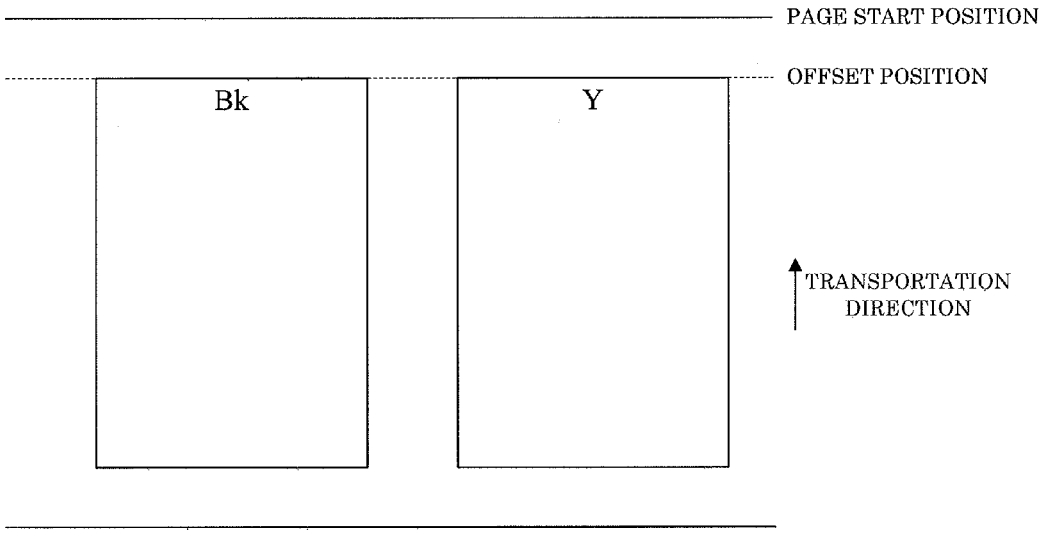
Fig.5 (PRIOR ART)
FIG. 5 (PRIOR ART) explanatory illustrates image data in the currently-used inkjet printing apparatus.
Figure 6:
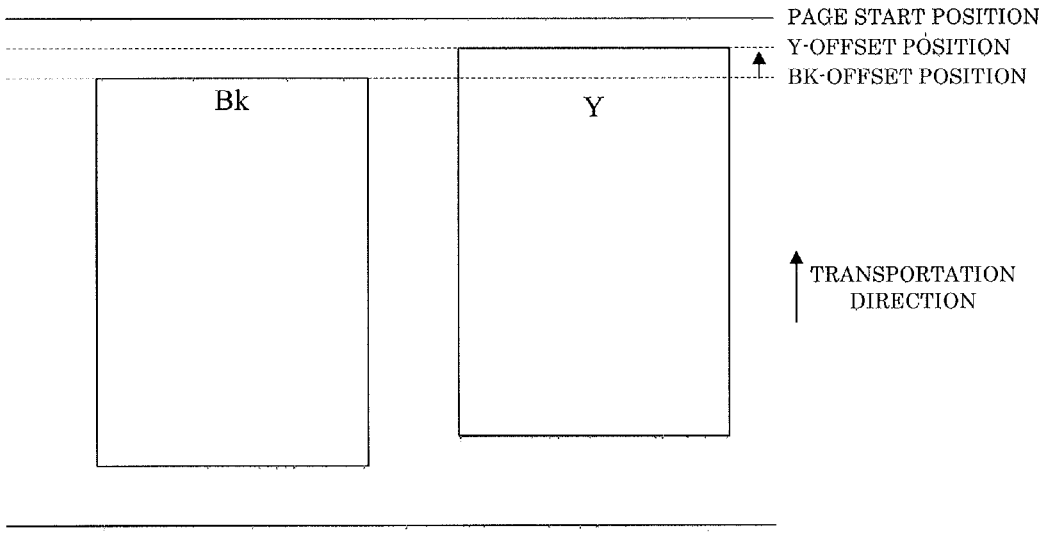
FIG. 6 explanatory illustrates image correction in the inkjet printing apparatus of Embodiment 1.

The offset corrector 52 performs correction to shift the offset position of the image data in the transportation direction individually in accordance with the shift amount S from the correction data generator 45, as illustrated in FIGS. 5 and 6. FIG. 5 illustrates an offset position as a reference of the image data for black (Bk) and yellow (Y). FIG. 6 illustrates a shifted offset position of the image data for yellow (Y). The image data has different shift amounts for colors. The image data with the corrected offset position is outputted to the printing timing controller 37. Here, the offset corrector 52 corresponds to the printing corrector in the present invention.

The printing timing controller 37 outputs the discharge signals to the inkjet heads 17*a* to 17*d* individually in accordance with the image data corrected for every color and the timing reference signal from the encoder 10, thereby controlling a timing of discharging the ink droplets.

Figure 7:
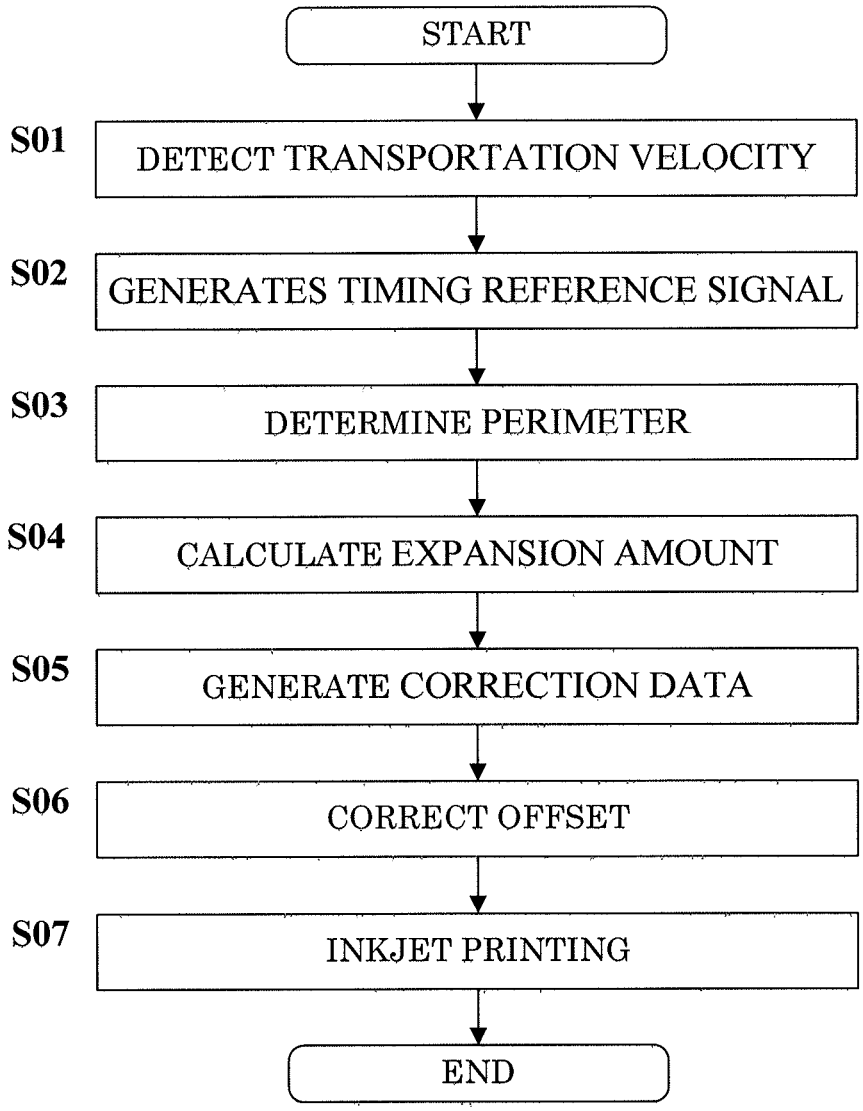
FIG. 7 is a flow chart illustrating correction of a color shift in Embodiment 1.

The following describes printing correction with reference to FIG. 7. FIG. 7 is a flow chart illustrating correction of the color shift according to Embodiment 1.

The transportation velocity $V_M$ of the web paper WP is detected with a drive signal to the motor 16 (Step S01). The encoder 10 attached to the transport roller 8 generates a pulse signal as a timing reference signal depending on the rotation of the transport roller 8 (Step S02). Transportation of the web paper WP causes the transport roller 8 to be heated and expanded as time elapses. Then, the perimeter of the transport roller 8 is determined in accordance with the detected transportation velocity and the timing reference signal (Step S03). A difference between the determined perimeter of the transport roller 8 and a reference perimeter set in advance is calculated, whereby an expansion amount of the perimeter of the transport roller 8 is calculated (Step S04). Then, the correction data of the image data is generated in accordance with the calculated expansion amount (Step S05). The offset of the image data is corrected in accordance with the generated correction data (Step S06). The inkjet printing unit 17 discharges ink droplets in accordance with the image data whose offset is corrected (Step S07), thereby allowing printing with the suppressed color shift.

Figure 8:
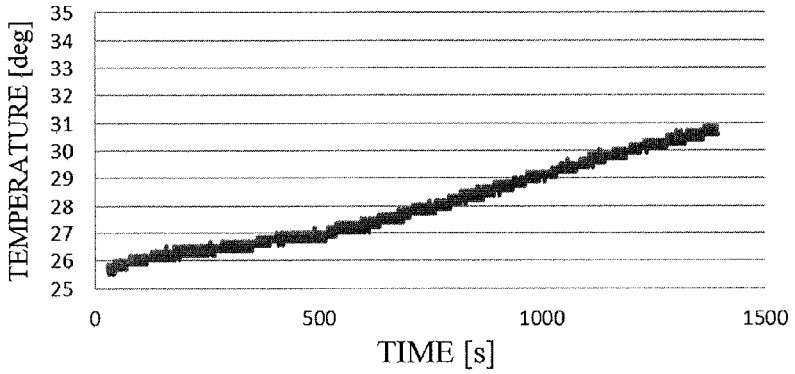
Fig.8 (PRIOR ART)
FIG. 8 (PRIOR ART) illustrates a graph indicating temperatures of an encoder roller of the currently-used inkjet printing apparatus.
Figure 9:
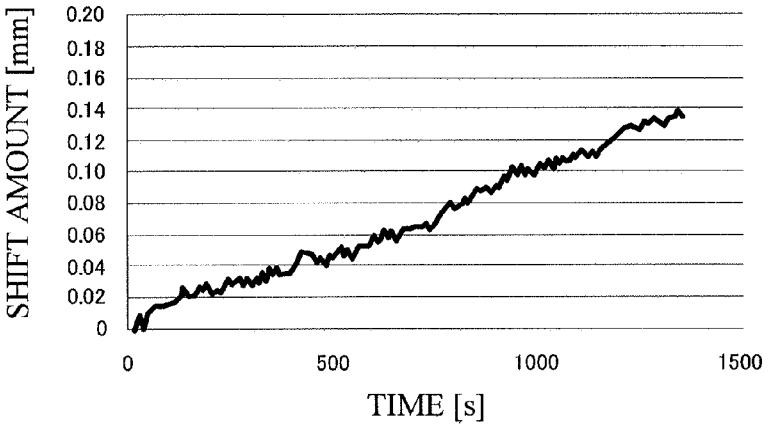
Fig.9 (PRIOR ART)
FIG. 9 (PRIOR ART) explanatorily illustrates a color shift upon printing in the currently-used inkjet printing apparatus.
Figure 10:
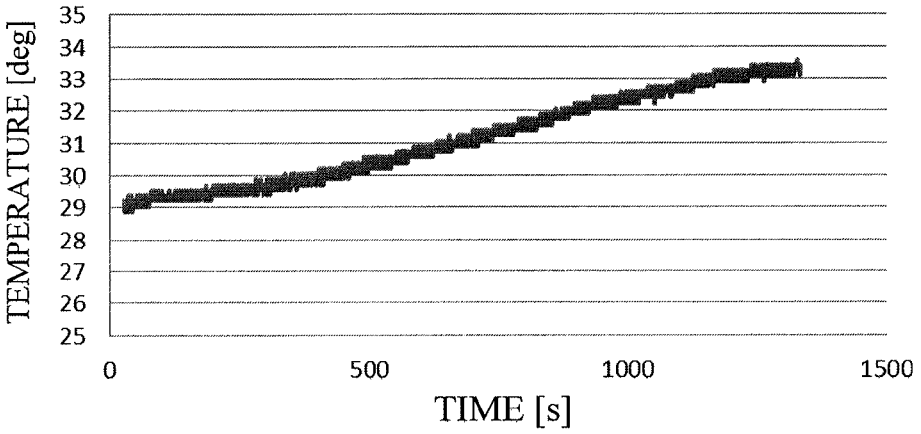
FIG. 10 illustrates a graph indicating temperatures of an encoder roller of the inkjet printing apparatus of Embodiment 1.
Figure 11:
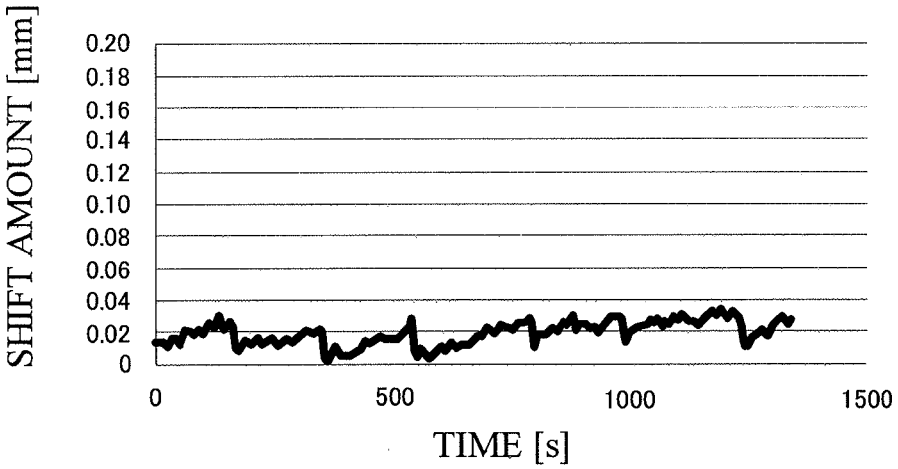
FIG. 11 explanatorily illustrates a color shift upon printing in the inkjet printing apparatus of Embodiment 1.

The following describes an effect of Embodiment 1 with reference to FIGS. 8 to 11. FIG. 8 is a graph indicating temperatures of the roller provided with the encoder of a currently-used inkjet printing apparatus. FIG. 9 illustrates a color shift upon printing in the currently-used inkjet printing apparatus. In other words, FIG. 9 illustrates a graph of a shift amount for colors black and yellow determined with a CCD camera. FIG. 10 is a graph indicating temperatures of a roller provided with an encoder of the inkjet printing apparatus according to Embodiment 1. FIG. 11 illustrates a color shift upon printing in the inkjet printing apparatus according to Embodiment 1. In other words, FIG. 11 illustrates a graph of an actual shift amount for colors black and yellow determined with a CCD camera in the inkjet printing apparatus according to Embodiment 1.

FIGS. 8 and 10 reveal that, in both the currently-used printing apparatus and the printing apparatus 1 of Embodiment 1, upon start of transportation of the print medium, a temperature of the roller provided with the encoder increases as time elapses. FIG. 9 reveals that, in the currently-used printing apparatus, a color shift amount also increases correspondingly to the increase in temperature of the roller. The temperature of the roller increases by approximately 5° C. for printing of approximately 1300 seconds. The thermal expansion of the roller results in a color shift between the image data for black and yellow of 0.14 mm.

In contrast to this, FIG. 11 reveals that, in the printing apparatus 1 of Embodiment 1, a color shift is corrected for every increase in color shift amount caused by increase in temperature of the roller provided with the encoder. As a result, the color shift amount has the maximum of around 1 pixel (i.e., approximately 21 μm at 1200 dpi). That is, the color shift amount is suppressed. As noted above, the printing apparatus 1 of Embodiment 1 allows suppression in timing shift of the printing in association with a time-dependent variation of the transport roller 8 provided with the encoder 10. This achieves reduction in color shift upon the printing.

In addition, in Embodiment 1, not a temperature but a thermal expansion amount of the perimeter of the transport roller 8 is determined for detecting the thermal expansion of the transport roller 8 provided with the encoder 10. Accordingly, more accurate determination is obtainable than the determination of thermal expansion through determination of the temperatures. Moreover, the configuration of Embodiment 1 can be achieved with no additional specific hardware. Consequently, the printing apparatus now in existence is applicable readily.

Embodiment 2

Figure 12:
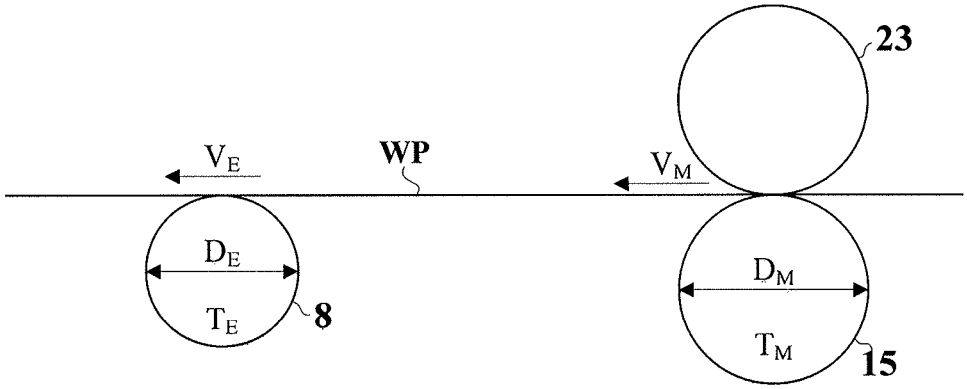
FIG. 12 illustrates determination of a perimeter of an encoder roller according to Embodiment 2 of the present invention.

The following describes Embodiment 2 of the present invention with reference to FIG. 12. FIG. 12 illustrates a method of determining a perimeter of a transport roller according to Embodiment 2. Embodiment 1 differs from Embodiment 2 in method of determining the perimeter of the transport roller 8. That is, a process in a perimeter determining unit 41 in Embodiment 2 differs from that in Embodiment 1. The configuration of printing apparatus other than that described below is common to that of Embodiment 1, and thus the description thereof is to be omitted.

Embodiment 2 has a feature to enhance an accuracy of color shift correction through correcting also an influence of thermal expansion on the drive roller 15 while the drive roller 15 and the transport roller 8 are made of different materials. That is, in the method of determining the perimeter of the transport roller 8 connected to the encoder 10 in Embodiment 2, the influence of the thermal expansion on the drive roller 15 connected to the motor 16 is also corrected. The following describes the method of determining the perimeter of the transport roller 8 in Embodiment 2.

It is assumed that a temperature $T_E$ of the transport roller 8 is equal to a temperature $T_M$ of the drive roller 15 (i.e., $T_E=T_M$). It is also assumed that a peripheral velocity $V_E$ of the transport roller 8 is equal to a peripheral velocity $V_M$ of the drive roller (i.e., $V_E=V_M$). A diameter of the transport roller 8 is denoted by $D_E$, and a diameter of the drive roller 15 is denoted by $D_M$. Moreover, a thermal expansion coefficient of the material of the transport roller 8 is denoted by $\gamma_E$, and a thermal expansion coefficient of the material of the drive roller 15 is denoted by $\gamma_M$. Moreover, time for one rotation of a load shaft of the motor 16 is denoted by $t_M$.

A peripheral velocity $V_{M0}$ of the drive roller with no variation in temperature is given by the following expression:

$$V_{M0}=\pi\cdot D_E/t_E=\pi\cdot D_M/t_M \tag{5}$$

A peripheral velocity $V_M$ of the drive roller with a variation in temperature of $\Delta T$ is given by the following expression:

$$V_M=\pi\cdot D_E(1+\Delta T\cdot\gamma hd\,E)/t_E=\pi\cdot D_M(1+\Delta T\cdot\gamma_M)/t_M \tag{6}$$

Here, time $t_M$ for rotation of the motor does not change due to heat. Consequently, the following expression holds:

$$V_M=V_{M0}\cdot(1+\Delta T\cdot\gamma_M) \tag{7}$$

$V_E=V_M$. Consequently, the following expressions hold:

$$L_E=(1+\Delta T\cdot\gamma_E)\cdot D_E\cdot\pi \tag{8}$$

$$L_E=T_E\cdot V_E=T_E\cdot V_0\cdot(1+\Delta T\cdot\gamma_M) \tag{9}$$

From the expression (8), the following is given:

$$\Delta T=1/\gamma_E\cdot\{L_E/(D_E\cdot\pi)-1\} \tag{10}$$

Substitution of the expression (10) into the expression (9) gives the following expression:

$$L_E=T_E\cdot V_0\cdot\{1+(\gamma_M/\gamma_E)\cdot(L_E/D_E\cdot\pi-1)\} \tag{11}$$

Consequently, the following expression holds:

$$L_E = \frac{\alpha - 1}{\frac{\alpha}{t_E \cdot V_{M0}} - \frac{1}{D_E \cdot \pi}} \quad (12)$$

where $\alpha = \gamma_E / \gamma_M$.

As noted above, the perimeter of the transport roller 8 is determinable while the influence of the thermal expansion on the drive roller 15 is corrected. This allows enhanced accuracy of correction of the color shift.

Moreover, for the enhanced accuracy through Embodiment 2, examples of the parameter may include a difference in temperature between the drive roller 15 and the transport roller 8. A temperature gradient of the transport roller 8 and the drive roller 15 is denoted by ξ. The calculation may be performed for each of the above expressions with $T_E = \xi T_M$. Here, the temperature gradient ξ should be determined in advance through calculation under various conditions.

Embodiment 3

Figure 13:
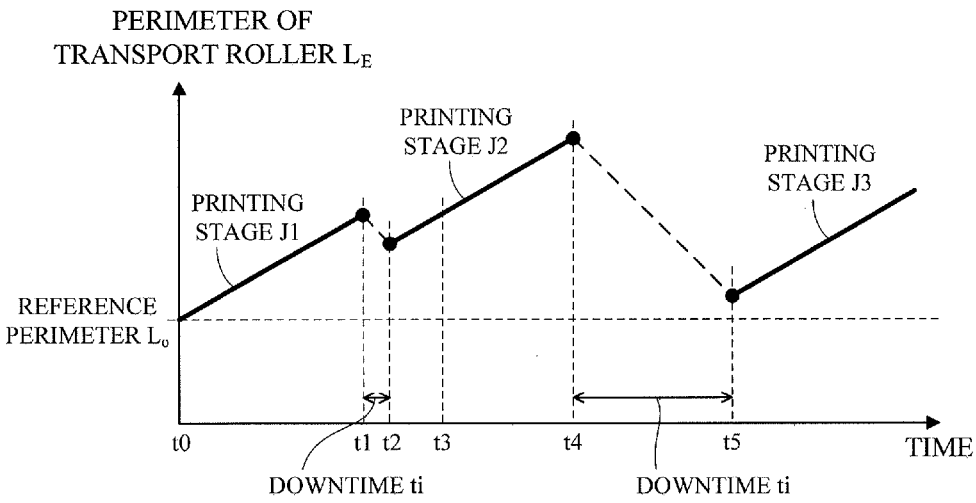
FIG. 13 illustrates a graph indicating a relationship between a printing time and downtime and a perimeter of a transport roller.

The following firstly describes a purpose of Embodiment 3 with reference to FIG. 13. FIG. 13 is a graph indicating a relationship between time when plurality of printing stages J1 to J3 are performed and the perimeter $L_E$ of the transport roller 8.

In the drawing, periods of time t0 to t1, t2 to t4, and a period f time subsequent to t5 are printing times when the printing stages J1, J2, and J3 are performed, respectively. On the other hand, periods of time from an end time t1 of the printing stage J1 to a start time t2 of the printing stage J2, and from an end time t4 of the printing stage J2 to a start time t5 of the printing stage J3 are each downtime ti when no printing is performed (i.e., the inkjet printing unit 17 is in a rest condition).

At the early of the printing stages J2 and J3 each performed after the downtime ti, a number of samples for the timing reference signal and the transportation velocity $V_M$ is small. Accordingly, the perimeter determining unit 41 may possibly determine the perimeter $L_E$ of the transport roller 8 with low accuracy in accordance with the timing reference signal and the transportation velocity $V_M$. FIG. 13 illustrates a period of time t2 to t3 when the perimeter determining unit 41 cannot determine the perimeter $L_E$ of the transport roller 8 with high accuracy. This causes the printing correction data with low accuracy at the start of the printing stages J2 and J3. As a result, it becomes difficult to reduce the color shift effectively. Consequently, the purpose of Embodiment 3 is to achieve further reduction in color shift upon printing by acquiring the printing correction data at the start of the printing with high accuracy.

As illustrated in FIG. 13, the perimeter $L_E$ of the transport roller 8 increases as the printing time becomes longer. In contrast to this, the perimeter $L_E$ of the transport roller 8 decreases to approach to a reference perimeter $L_o$ of the transport roller 8 as the time downtime ti becomes longer.

Regarding the above circumstances, in Embodiment 3, printing correction data is estimated upon the start of the printing without using the timing reference signal and the transportation velocity $V_M$ obtained in real time during the printing. Specifically, the printing stages J1 and J2 are performed in tandem temporally across a downtime ti. Printing correction data at the start time t2 of the posterior printing stages J2 is estimated in accordance with printing correction data at the end time t1 of the anterior printing J1 and the downtime ti. Then, printing correction is performed in accordance with the estimated printing correction data at the early of the printing stage J2 (e.g., a period of time from the start time t2 of the printing stage J2 to the time t3).

In the following description, the "anterior printing stage" is referred to as a "last printing stage" or a "previous printing stage" where appropriate, and the "posterior printing stage" is referred to as "this printing stage" where appropriate. Moreover, a shift amount S may be used as the "printing correction data at the end time t1 of the anterior printing stage J1". Alternatively, instead of the shift amount S, the perimeter $L_E$ or the difference ΔL may be used. That is because the relationship of the expressions (3) and (4) described in Embodiment 1 also holds in Embodiment 3, and thus the shift amount S is determinable uniquely with either the perimeter $L_E$ or the difference ΔL.

The following describes Embodiment 3 in detail. The configuration of a printing apparatus in Embodiment 3 is similar to that in Embodiment 1. Embodiment 3 includes a function of a printing correction data generator 33 (especially, an expansion determining unit 43) in addition to the configurations of Embodiment 1. Consequently, an additional function of the printing correction data 33 is to be described, and the description of the other configurations is to be omitted.

The expansion determining unit 43 stores an end time of one printing stage and a difference ΔLend at the end of the printing stage every termination of the printing stage.

The expansion determining unit 43 monitors a transportation distance of the web paper WP. The transportation distance is determined in accordance with the transportation velocity $V_M$ detected by the transportation velocity detector 32 and elapsed time from the start of the printing stage.

The expansion determining unit 43 switches a process of obtaining a difference ΔL depending on whether or not the transportation distance of the web paper WP after the start of the printing stage is equal to or more than a reference distance. Here, the reference distance is, for example, 50 [m]. If the transportation distance is equal to or more than the reference distance, the difference ΔL is determined by the approach described in Embodiment 1. If the transportation distance is less than the reference distance, a difference ΔLst at the start of the printing stage is estimated. The following describes how to estimate the difference ΔLst.

The expansion determining unit 43 compares downtime ti, between this printing stage and the last printing stage, with a given value. Here, the downtime ti is obtained with reference to the end time of the printing stage already stored. The given value is, for example, 60 [min].

If the downtime ti is less than the given value, the expansion determining unit 43 estimates the difference ΔLst in accordance with the difference ΔLend at the end of the last printing stage and the downtime ti. Specifically, the difference ΔLend and the downtime ti are substituted into the expression (13) to obtain a difference ΔLst.

$$\Delta Lst = \Delta Lend \cdot \exp(-b \cdot ti) \quad (13)$$

where b denotes a coefficient determined in advance through experiments. Here, b is, for example, 0.032331 with a unit of the downtime of [min].

Figure 14:
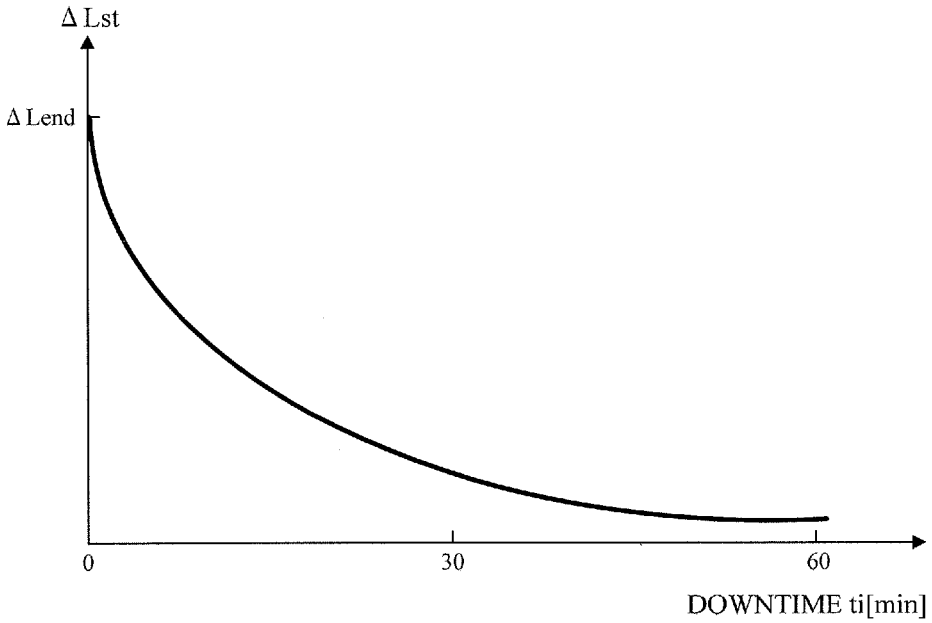
FIG. 14 illustrates a graph indicating a relationship between the downtime and a difference in perimeter of the transport roller.

FIG. 14 is a graph indicating a relationship between the downtime ti and the difference ΔLst given by the expression (13).

On the other hand, if the downtime ti is equal to or more than the given value, the difference ΔLst is estimated as a constant C set in advance. For instance, if the downtime ti is equal to or more than the given value, the constant C is set zero when the perimeter $L_E$ of the transport roller 8 is estimated to be equal to the reference perimeter $L_o$. However, the value of the constant C is not limited to zero. For instance, a value other than zero with low values is settable as the constant C.

$$\Delta Lst=C \quad (14)$$

The expansion determining unit 43 output the determined difference ΔL or the estimated difference ΔLst to the correction data generator 45.

If the correction data generator 45 receives the estimated difference ΔLst, the correction data generator 45 substitutes the difference ΔLst into ΔL in the expression (4) to estimate a shift amount S.

Figure 15:
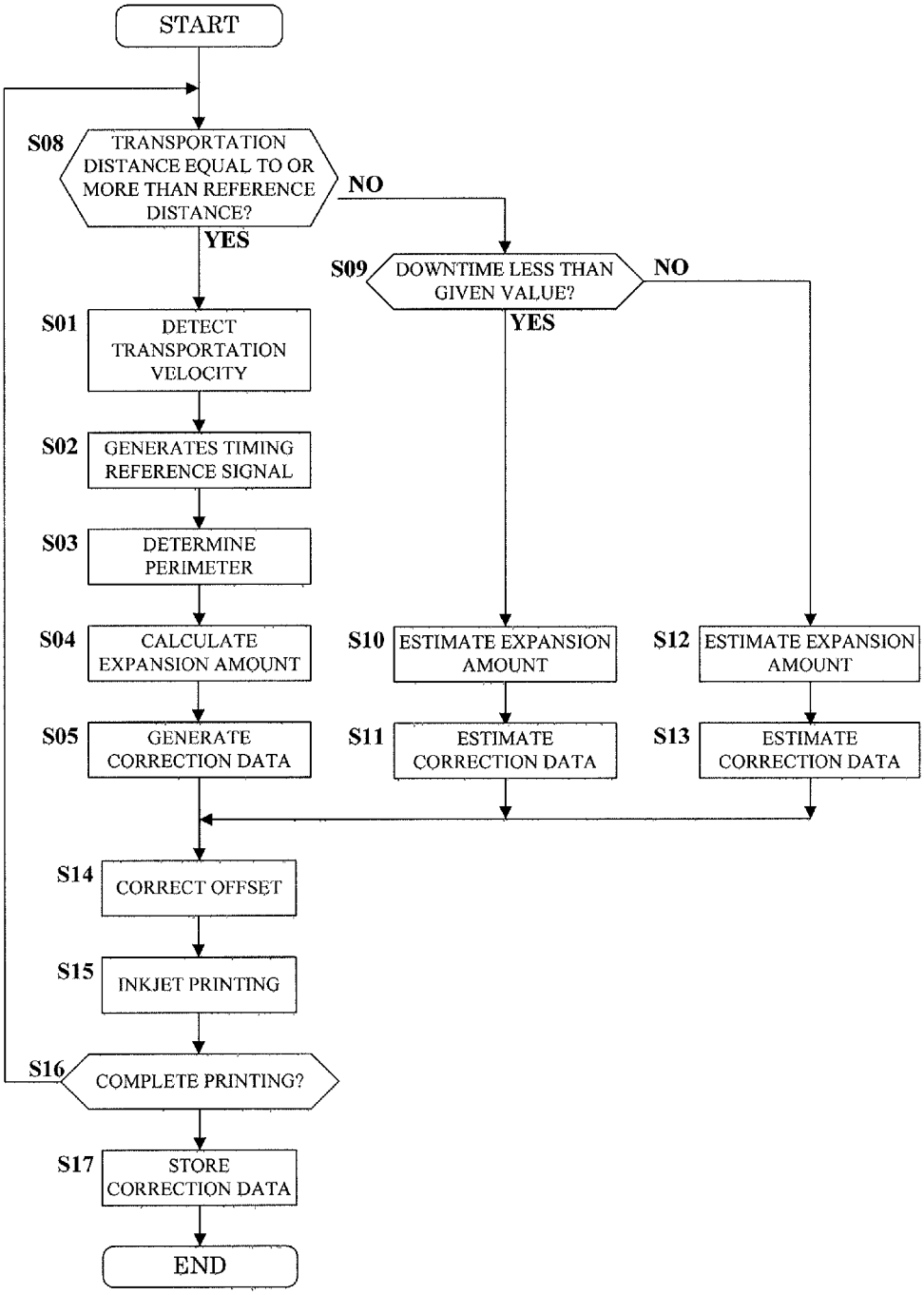
FIG. 15 is a flow chart illustrating correction of a color shift according to Embodiment 3 of the present invention.

The following describes printing correction of one printing stage with reference to FIG. 15. The same numerals in Embodiment 1 are given to steps S in Embodiment 3 for the omission of their description in detail.

The expansion determining unit 43 determined whether or not the transportation distance of the web paper WP from the start of the printing is equal to or more than a reference distance (Step S08). If the transportation distance is equal to or more than the reference distance, the printing correction data generator 33 performs Steps S01 to S05 to generate printing correction data (shift amount S). If the transportation distance is less than the reference distance, the expansion determining unit 43 determines whether or not the downtime ti is less than the given value (Step S09). If the downtime ti is less than the given value, the expansion determining unit 43 estimates a difference ΔLst in accordance with the difference ΔLend and the downtime ti. That is, an expansion amount of the perimeter $L_E$ of the transport roller 8 is estimated (Step S10). The correction data generator 45 estimates a shift amount S in accordance with the estimated difference ΔLst. That is, printing correction data is estimated (Step S11). If the downtime ti is equal to or more than the given value, the expansion determining unit 43 estimates the difference ΔLst as a constant C (Step S12). The correction data generator 45 estimates a shift amount S in accordance with the estimated difference ΔLst (Step S13). The offset corrector 52 generates image data whose offset is corrected in accordance with the printing correction data. Specifically, printing correction is performed in accordance with the estimated shift amount S from the start of the printing until the transportation distance of the web paper WP reaches the reference distance, and printing correction is performed in accordance with the generates shift amount S after the transportation distance of the web paper WP reaches the reference distance (Step S14). Then the inkjet printing unit 17 discharges ink droplets in accordance with the image data whose offset is corrected (Step S15).

The foregoing processes are repeated until one printing stage is completed (Step S16). When the printing is completed, the expansion determining unit 43 stores the difference ΔLend at the end of the printing and an end time of the printing (step S17). If the transportation distance of the web paper WP is equal to or more than the reference distance, the difference ΔLend at the end time of the printing is generated in accordance with the timing reference signal and the transportation velocity $V_M$ at the end of the printing.

With Embodiment 3 mentioned above, the printing correction data generator 33 allows estimation of the printing correction data at the start of the printing after the downtime ti with high accuracy. This results in efficient reduction in color shift at the early of the printing.

Moreover, the printing correction data generator 33 changes estimation of the shift amount S depending on a length of the downtime ti. Specifically, the downtime ti is divided into two types, i.e., downtime ti of less than given value and that of not less than the given value. In the former, the expression (13) is used for estimation, and in the latter the expression (14) is used for estimation. This allows accurate estimation of the printing correction data regardless of the length of the downtime ti.

The printing correction data generator 33 estimates the printing correction data in accordance with the difference ΔLend and the downtime ti (steps S09 to S13) and generates the printing correction data in accordance with the timing reference signal and the transportation velocity $V_M$ (Steps S01 to S05) in parallel. This allows accurate acquirement of the printing correction data both at the early of the printing and thereafter.

Then the printing correction data generator 33 determines a timing of switching from estimation of the printing correction data to generation of the printing correction data in accordance with the transportation distance of the web paper WP from the start of the printing. Accordingly, a large number of samples for the timing reference signal and the transportation velocity $V_M$ are obtainable. This allows suitable selection of a timing of generating the printing correction data accurately as the timing of switching in accordance with the timing reference signal and the transportation velocity $V_M$.

Then the printing correction data generator 33 switches from the estimated printing correction data, to be outputted to the offset corrector 52, to the printing correction data generated from the timing reference signal and the transportation velocity $V_M$ in accordance with the transportation distance of the web paper WP from the start of the printing. This allows effective reduction in color shift both at the early of the printing and thereafter.

The present invention is not limited to the foregoing examples, but may be modified as follows.

(1) In the embodiments mentioned above, the image data is corrected depending on the thermal expansion of the transport roller 8. However, this is not limitative. Instead of correction of the image data, a discharge timing of the ink droplets to the web paper WP by the inkjet printing unit 17 may be corrected to be put ahead in accordance with the difference ΔL calculated from the expression (3). Such a configuration also allows reduction in color shift upon the printing.

(2) In the embodiments mentioned above, four colors are printed with the inkjet heads 17*a* to 17*d*, respectively. However, this is not limitative. For instance, six colors may be printed.

(3) In the embodiments mentioned above, the encoder 10 is provided in the transport roller 8 other than the drive roller 15. However, this is not limitative. For instance, the encoder 10 may be provided in the drive roller 15.

(4) In the embodiments mentioned above, the inkjet printing apparatus 1 has been described as one example. However, another printing apparatus may be adopted. For instance, examples of the inkjet printing apparatus include an indirect offset inkjet printing apparatus using a blanket belt and a plateless printing apparatus. Moreover, the web paper WP for the print medium has been described as one example of the recording medium. Alternatively, the web paper WP may be a paper sheet. Moreover, the recording medium is not limited to paper, and may be strip foil such as a plastic sheet.

(5) In the embodiments mentioned above, the correction image data is generated for every color. However, this is not limitative. The image data or discharge timings of the other inkjet heads may be corrected with reference to an inkjet head closest to the encoder 10.

(6) In the embodiments mentioned above, the difference ΔLst is estimated in accordance with the difference ΔLend and the downtime ti. See the expression (13). However, this is not limitative. The difference ΔLst may be estimated also in consideration with an atmosphere temperature around the transport roller 8 (hereinafter, referred to as a "surrounding temperature").

In the above modification, the inkjet printing apparatus 1 includes a surrounding temperature detector, not shown, detecting a surrounding temperature TS of the transport roller 8.

The printing correction data generator 33 (expansion determining unit 43) stores the surrounding temperature TS at the end of one printing stage every termination of the printing. Moreover, the expansion determining unit 43 estimates a difference ΔLst upon start of this printing stage in accordance with the difference ΔLend at termination of the previous printing stage, the surrounding temperature TSend at the termination of the previous printing stage, the downtime ti, and the surrounding temperature TSst upon the start of this printing stage. Specifically, the difference ΔLend, the downtime ti, the surrounding temperatures Tend and Tst are substituted into the expression (15), whereby a difference ΔLst is obtained.

$$\Delta Lst=(\Delta L\text{end}\cdot\exp(-b\cdot ti)+(TS\text{end}-TSst)\cdot k1)\cdot k2 \quad (15)$$

where the numerals b, k1, and k2 each denote a coefficient determined in advance through experiments. In addition, strictly speaking, a time when the surrounding temperature TSst is detected is not necessarily a start time of the printing, but may be before the start of the printing.

Figure 16:
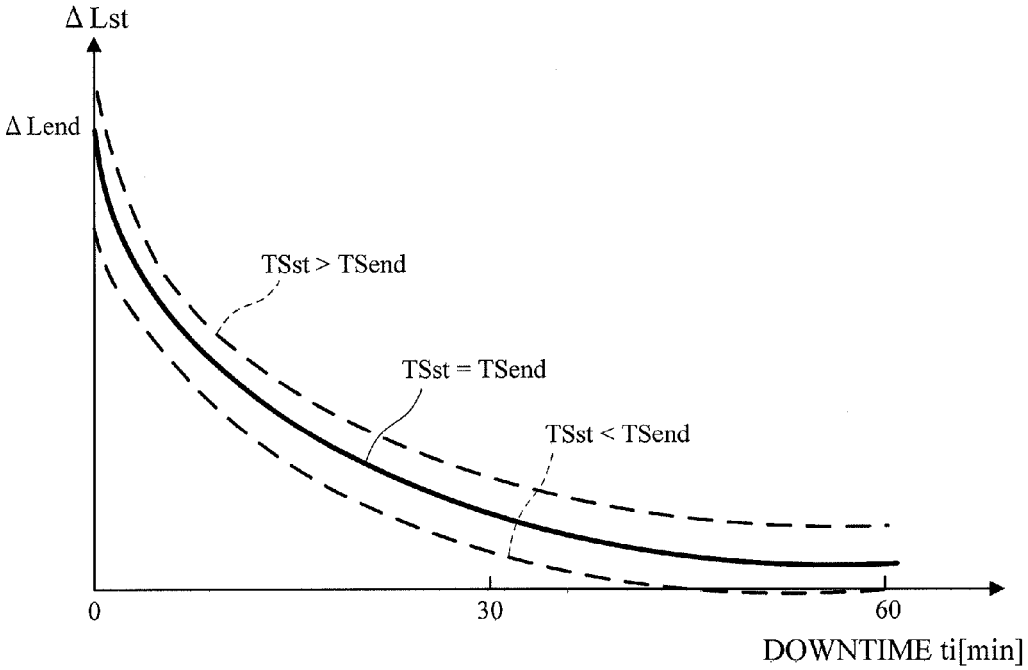
FIG. 16 illustrates a graph indicating a relationship between the downtime and the difference in perimeter of the transport roller.

FIG. 16 is a graph indicating a relationship between the downtime ti and the difference ΔLst given by the expression (15). As illustrated in FIG. 16, if the surrounding temperature TSst is equal to the surrounding temperature TSend, the difference ΔLst given by the expression (15) is equal to the difference ΔLst given by the expression (13). If the surrounding temperature TSst is higher than the surrounding temperature TSend, the difference ΔLst given by the expression (15) is larger than the difference ΔLst given by the expression (13). If the surrounding temperature TSst is lower than the temperature TSend, the difference ΔLst given by the expression (15) is smaller than the difference ΔLst given by the expression (13).

With the modification, the difference ΔLst is estimated taking into consideration of an influence of the variation in surrounding temperature TS of the transport roller 8 on the difference ΔLst. Accordingly, further accurate estimation of the printing correction data upon the start of the printing is obtainable. This results in further effective reduction in color shift at the early of the printing.

(7) In the embodiments mentioned above, the printing correction data generator 33 estimates the shift amount S with the difference ΔLend. See steps S10 to S13. However, this is not limitative. For instance, the shift amount S may be estimated with the shift amount S instead of the difference ΔLend. Specifically, the printing includes an anterior printing stage and a posterior printing stage performed in tandem temporally across the downtime ti. The printing correction data generator 33 stores the shift amount Send at the termination of the printing, and estimates the shift amount S upon the start of the posterior printing stage in accordance with the shift amount Send upon the termination of the anterior printing stage and the downtime ti. Such modification may be adopted. The correction data generator 45 may perform estimation of the shift amount S mentioned above partially or entirely. The modification also allows further effective estimation of the printing correction data upon the start of the printing. This results in much satisfied reduction in color shift at the beginning of the printing.

(8) In the embodiments mentioned above, the printing correction data generator 33 switches the shift amount S, to be outputted to the offset corrector 52, in accordance with the transportation distance of the web paper WP from the start of the printing. However, this is not limitative. For instance, the printing correction data generator 33 may switch the shift amount S, to be outputted to the offset corrector 52, in accordance with the elapsed time from the start of the printing. Alternatively, the printing correction data generator 33 may switch the shift amount S, to be outputted to the offset corrector 52, in accordance with the transportation distance of the web paper WP from the start of the printing and the elapsed time from the start of the printing. Such a modification also allows suitable selection of a timing when the printing correction data can be generated appropriately. As a result, effective reduction in color shift is obtainable both at the early of the printing and thereafter.

(9) In the embodiments mentioned above, the printing correction data generator 33 changes estimation of the shift amount S in accordance with the length of the downtime ti. However, this is not limitative. Specifically, the printing correction data generator 33 may estimate the shift amount S by one approach regardless of the length of the downtime ti. For instance, the steps S09, S12, and S13 in the flow chart of FIG. 15 may be omitted.

The present invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus with a printing unit performing printing onto a recording medium to be transported, the apparatus comprising:

a transporting unit transporting the recording medium;

a transportation velocity detector detecting a transportation velocity of the recording medium;

a timing reference signal generator generating a timing reference signal of the printing by the printing unit in accordance with transportation of the recording medium;

a printing correction data generator generating printing correction data in accordance with the transportation velocity and the timing reference signal so as to correspond to a time-dependent variation of the timing reference signal generator; and a printing corrector correcting the printing of the printing unit to the recording medium in accordance with the printing correction data, the timing reference signal generator comprising:

a roller contacting to the recording medium; and an encoder connected to the roller, wherein the timing reference signal is a detection signal of the encoder, the time-dependent variation of the timing reference signal generator corresponds to a variation in perimeter of the roller to which the encoder is connected, and the printing correction data generator obtains the variation in perimeter of the roller to which the encoder is connected in accordance with the transportation velocity and the timing reference signal, and generates the printing correction data in accordance with the variation in perimeter of the roller to which the encoder is connected.

2. The printing apparatus according to claim 1, wherein the printing correction data generator stores a variation in perimeter of the roller upon termination of the printing, and estimates printing correction data upon start of a posterior printing stage of the printing across downtime in accordance with the downtime and the perimeter of the roller upon termination of an anterior printing stage of the printing, the printing including the posterior printing stage and the anterior printing stage.

3. The printing apparatus according to claim 2, wherein the printing correction data generator switches the printing correction data, to be outputted to the printing corrector, from the estimated printing correction data to the printing correction data, generated in accordance with the transportation velocity and the timing reference signal, depending on at least either a transportation distance of the recording medium from start of the printing or elapsed time from the start of the printing.

4. The printing apparatus according to claim 1, wherein the transporting unit includes a transport roller transporting the recording medium and a motor driving the transport roller, and the transportation velocity detector detects the transportation velocity in accordance with a drive command signal to the motor.

5. The printing apparatus according to claim 4, wherein the printing correction data generator generates printing correction data also in accordance with the variation in perimeter of the transport roller.

6. The printing apparatus according to claim 1, wherein the printing correction data generator stores the printing correction data upon termination of the printing, and estimates printing correction data upon start of a posterior printing stage of the printing across downtime in accordance with the downtime and the printing correction data upon termination of an anterior printing stage of the printing, the printing including the posterior printing stage and the anterior printing stage.

7. The printing apparatus according to claim 6, wherein the printing correction data generator switches the printing correction data, to be outputted to the printing corrector, from the estimated printing correction data to the printing correction data, generated based on the transportation velocity and the timing reference signal, depending on at least either a transportation distance of the recording medium from start of the printing or elapsed time from the start of the printing.

8. The printing apparatus according to claim 1, wherein the printing corrector corrects an offset of an image data in the transportation direction in accordance with the printing correction data.

9. The printing apparatus according to claim 1, wherein the printing unit includes inkjet heads each discharging ink droplets, and the printing corrector corrects a discharge timing of the ink droplets to the recording medium in accordance with the printing correction data.

10. A printing method of performing printing onto a recording medium to be transported, the method comprising:

a transportation velocity detecting step of detecting a transportation velocity of the recording medium;

a timing reference signal generating step of generating a timing reference signal of the printing generated by a timing reference signal generator in accordance with the recording medium;

a printing correction data generating step of generating printing correction data in accordance with the transportation velocity and the timing reference signal so as to correspond to a time-dependent variation of the timing reference signal generator; and a printing correcting step of correcting the printing of the printing unit to the recording medium in accordance with the printing correction data, wherein the timing reference signal generator comprises:

a roller contacting to the recording medium; and an encoder connected to the roller, the timing reference signal is a detection signal of the encoder, the time-dependent variation of the timing reference signal generator corresponds to a variation in perimeter of the roller to which the encoder is connected, and the printing correction data generator obtains the variation in perimeter of the roller to which the encoder is connected in accordance with the transportation velocity and the timing reference signal, and generates the printing correction data in accordance with the variation in perimeter of the roller to which the encoder is connected.

11. The printing method according to claim 10, wherein the printing unit includes inkjet heads each discharging ink droplets, and the printing correcting step includes correcting a discharge timing of the ink droplets to the recording medium in accordance with the printing correction data.

* * * * *